US005456362A

United States Patent [19]

Laskowski et al.

[11] Patent Number: 5,456,362

[45] Date of Patent: Oct. 10, 1995

[54] FLUTATION PROCESS FOR THE FLUTATION OF COARSE FRACTIONS OF POTASH ORES

[75] Inventors: Janusz S. Laskowski, Richmond; Qun Wang, Vancouver, both of Canada

[73] Assignee: The University of British Columbia, Vancouver, Canada

[21] Appl. No.: 249,508

[22] Filed: May 26, 1994

[51] Int. Cl.[6] ..... B03D 1/02; B03D 1/10; B03D 1/24

[52] U.S. Cl. ..... 209/164; 209/166; 209/170

[58] Field of Search ..... 209/164, 166, 209/168, 170

[56] References Cited

U.S. PATENT DOCUMENTS

| | | | |
|---|---|---|---|
| 2,689,649 | 9/1954 | Atwood . | |
| 2,721,657 | 10/1955 | Smith . | |
| 2,758,714 | 8/1956 | Hollingsworth . | |
| 2,936,887 | 5/1960 | Wilson . | |
| 2,937,751 | 5/1960 | Schoeld . | |
| 3,310,170 | 3/1967 | Abernathy . | |
| 3,424,310 | 1/1969 | Wilson . | |
| 3,730,341 | 5/1973 | Mames et al. | 209/164 |
| 4,379,741 | 4/1983 | Sano et al. | 204/424 |
| 4,592,834 | 6/1986 | Yang | 209/166 |
| 4,750,994 | 6/1988 | Schneider | 209/170 |
| 4,822,493 | 4/1989 | Barbery et al. | 210/703 |
| 4,883,586 | 11/1989 | Bierman et al. | 209/167 |
| 4,960,509 | 10/1990 | McNeill | 209/164 |
| 4,971,685 | 11/1990 | Stanley et al. | 209/170 |
| 4,981,582 | 1/1991 | Yoon . | |
| 5,167,798 | 12/1992 | Yoon . | |
| 5,192,423 | 3/1993 | Duczmal et al. | 209/164 |
| 5,307,937 | 5/1994 | Hutwelker | 209/164 |

FOREIGN PATENT DOCUMENTS

| | | |
|---|---|---|
| 47135 | 3/1982 | European Pat. Off. . |
| 2162092 | 1/1986 | United Kingdom . |

*Primary Examiner*—Thomas M. Lithgow

*Attorney, Agent, or Firm*—Richard P. Fennelly; Louis A. Morris

[57] ABSTRACT

A process for the flotation of coarse potash ore fractions in an aqueous brine containing frother that comprises: (a) using a column flotation device in which air bubbles are generated by a sparger that utilizes high intensity shearing to mix and disperse air into brine containing frother; (b) removing a portion of the suspension at another point in the direction of flow of the suspension to regulate the upward flow rate of the suspension past the point where the air is dispersed into the suspension and thereby reducing fine particles entrainment in the froth product. The suspension can be conditioned with an aqueous composition comprising a hydrocarbon extender oil and a substantially saturated long chain primary mine, optionally comprising an acid, such as a mineral acid or carboxylic acid, to emulsify the oil in the composition, or can be conditioned with an aqueous composition comprising a long chain primary amine having an iodine value ranging from about 20 to about 70 cg/g.

11 Claims, 3 Drawing Sheets

NET UPWARD BRINE VELOCITY, cm/sec

| | | |
|---|---|---|
| GRADE | ◆ | 0.17 |
| | ■ | 0.83 |
| | ▲ | 1.66 |
| FLOT REC. | ◇ | 0.17 |
| | □ | 0.83 |
| | △ | 1.66 |

FLUTATION PROCESS FOR THE FLUTATION OF COARSE FRACTIONS OF POTASH ORES

BACKGROUND OF THE INVENTION

General practice in potash ore flotation aims at maximum recovery of coarse sylvite (KCl) particles. Depending on sylvite grain size, the potash ores are ground to either −6 mesh (3.36 mm) or −8 mesh (2.33 mm) and are classified into +20 mesh (0.85 mm) coarse and −20 mesh fine streams. In order to achieve maximum recovery of the coarse particles, these two streams are reagentized separately and then are usually floated together in mechanical flotation cells. Owing to the intense stirring and turbulence in mechanical cells, flotation recoveries of coarse sylvite particles are commonly low (around 60%), and slime release is severe due to attrition and breakage of the coarse particles.

Flotation columns, which belong to a family of pneumatic flotation machines, have been widely applied in the flotation of fine mineral particles. Wash water supplied to the froth at the top of the column is commonly used to clean the froth products. Columns were also shown to perform better in the flotation of coarse particles [J. Laskowski & M. Marchewicz, Przeglad Gorniczy, 25:438–441 (1969)]. Nearly quiescent conditions in a column provide an ideal environment for coarse particle flotation. Upward pulp flow, co-current to the rising bubbles, was shown to further improve the flotation of coarse particles by assisting in the levitation of heavy particle-bubble aggregates (J. S. Laskowski & W. Bartoniek, Przeglad Gorniczy, 26:250–255 (1970); French Patent, 1,499,990 (1968); G. A. Gruber and M. E. Kelahan, Column Flotation '88, 191–201 (1988); U.S. Pat. No. 4,822,493 (1989); H. Soto and G. Barbery, Miner. & Metall. Process, Feb., 16–21 (1991)]. A pilot plant flotation column with the upward pulp flow was also tested [W. Aliaga and H. Soto, Trans. IMM, 102: C70–73 (1993)].

Spargers used to disperse air into flotation columns are commonly made from porous materials, or cloth on perforated pipe. While such spargers may provide satisfactory air dispersion in pulps with low-electrolyte concentration, at high electrolyte concentration of saturated brine the conditions are entirely different. It was observed that air dispersion through a porous sparger was poor in saturated brine. Spargers employing mechanical forces (shear flow, turbulence, pressure change, etc.) to premix air and liquid have been recognized to provide much better air dispersion in flotation columns. Bubbles generated in such a way are much finer than those generated by porous materials and their maintenance is much easier. With this type of spargers frother is commonly introduced into the liquid stream supplied to the sparger to further assist in the dispersion of air. In mechanical cells, air bubbles are produced by shearing caused by impellers and a high electrolyte concentration does not affect air dispersion significantly.

There are a few other features which make the potash flotation systems differ from conventional flotation. The difference in density between sylvite particles (1.99 g/cm$^3$) and saturated brine (1.23 g/cm$^3$) is small. The upward flow is, therefore, less important in the levitation of coarse sylvite particle-loaded bubbles. Because of the high brine density and viscosity, an upward flow may even significantly increase the entrainment of fine gangue mineral particles in concentrate and decrease concentrate grade. Therefore, the rate of the upward flow has to be carefully regulated to achieve the balance between the levitation of coarse potash particles and the fine gangue entrainment.

SUMMARY OF THE INVENTION

The present invention relates to a flotation process for the beneficiation of a coarse potash ore fraction in saturated brine containing frother which comprises: (a) using a column-type flotation device in which fine air bubbles are generated by a sparger utilizing high intensity shearing to mix and disperse air into the brine containing the frother; (b) removing a portion of the suspension at another point in the direction of flow of the suspension to regulate the upward flowrate of the suspension past the point where the air is dispersed into the suspension and to thereby reducing fine particle entrainment of frother products; and (c) floating the coarse potash fraction in the column following conditioning in the presence of a frother with a hydrocarbon extender oil and/or a long chain primary amine.

DESCRIPTION OF PREFERRED EMBODIMENTS

Figure 1:
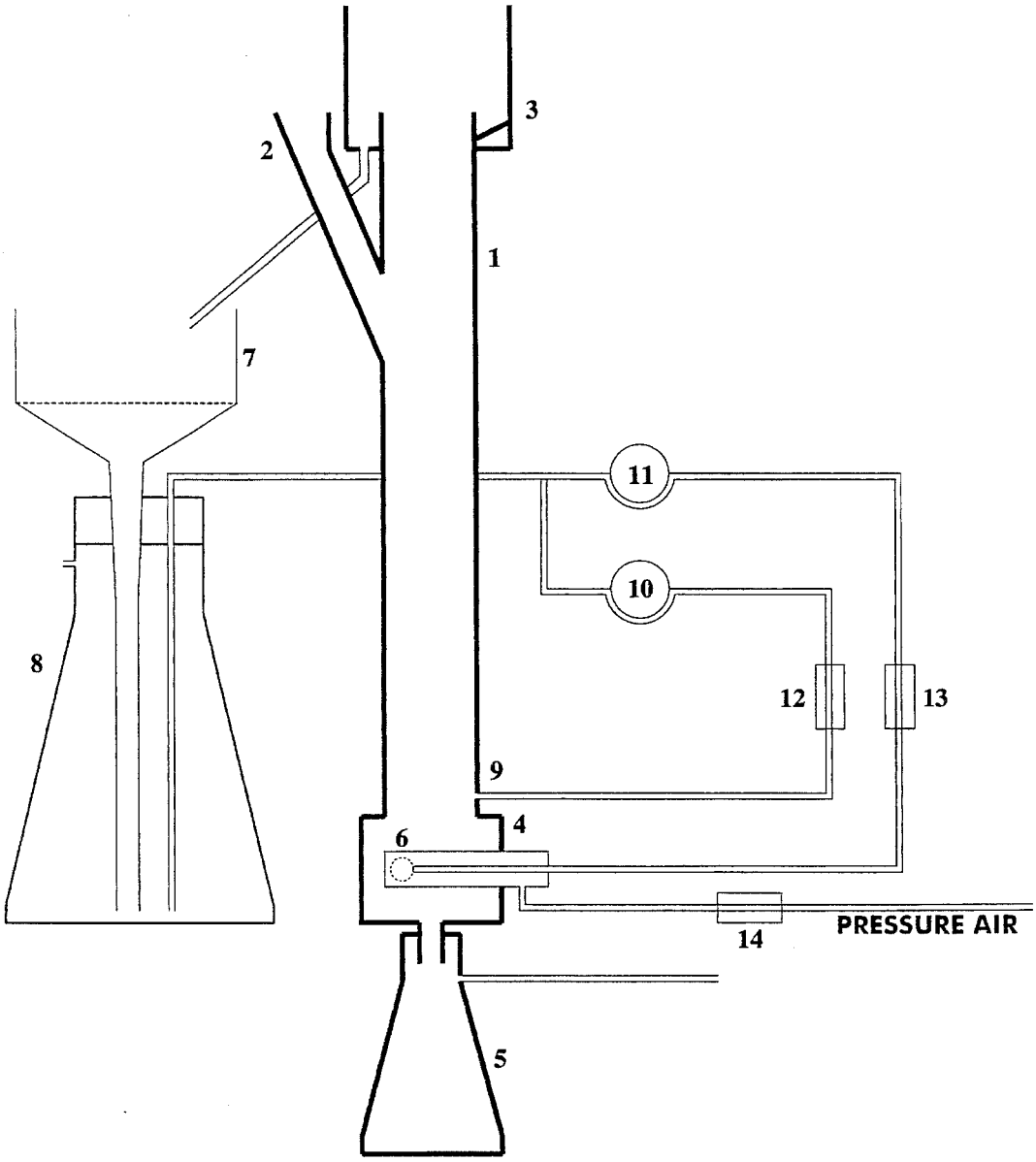
FIG. 1 is a schematic representation of a prototype flotation column adapted to the present invention.

The present invention is based on the following observations:

i) Coarse fractions of potash ores should be floated separately, preferably in a flotation column in which nearly quiescent conditions reduce the negative effect of turbulence on coarse particle flotation.

ii) It is beneficial to utilize shearing to assist in the dispersion of air into brine and the presence of a frother in the brine stream mixed with air in a sparger can further assist in air dispersion.

iii) Because of the small density difference between saturated brine and sylvite, the upward pulp flow is not necessary for the levitation of the bubbles loaded with coarse sylvite particles and too high an upward flow may lead to severe entrainment of fine gangue. The high rate of brine flow needed for a high intensity shearing in the sparger has to be regulated to reduce the deleterious effect of a too high upward flow.

iv) Oil used as extender in the flotation of coarse potash fractions should contain more than 1% of dissolved saturated long-chain amines, and the amine-containing oil works better when emulsified in water containing a mineral acid or a carboxylic acid.

This invention comprises of (i) conditioning of the coarse potash ore fraction with an extender oil and/or long chain primary amine and a frother; (ii) the use of the flotation column equipped with the sparger that utilizes high-intensity shearing to disperse air into a flowing brine which contains a frother; (iii) removing a portion of the pulp at another point in the direction of flow of the suspension past the point where the air is dispersed into the suspension and thereby reducing upward pulp flow in the column.

A few important features of the prototype column described in this invention are given below. The column comprises of a vertical main chamber 1 with an open top, a feeding port 2, an overflow launder 3 at the top of the column, a sparger chamber 4 at the bottom part of the column, and a tailing receiver 5 at the bottom. The "shear" sparger 6 utilizes a high rate of liquid flow which passes through and meets pressurized air at the surface of the air nozzle(s) made from porous material to generate fine bubbles by shearing. A high rate of brine flow containing frother is fed to the sparger partly from the overflow stream after solid-liquid separation in the concentrate receiver, which consists of a screen 7 and a brine container 8, and partly from a port 9. Pumps 10 and 11 and flowmeters 12 and 13 serve to regulate the rate of the shear flow injected to the sparger and the net upward brine velocity inside the column. Flowmeter 14 regulates the air flowrate passing through the sparger. Coarse fractions of potash ores, following reagentizing with surfactants and oil, are fed from the feeding port into the column filled with brine containing finely dispersed bubbles. Hydrophobic particles of potash minerals attach to and lifted by rising air bubbles are collected in the concentrate receiver. Hydrophilic gangue particles settle down to the bottom of the column and are collected in the tailing receiver 5.

The present invention is further illustrated by the Examples which follow.

EXAMPLE 1

A prototype column, as shown in FIG. 1, was constructed with a Plexiglas tube of 63 mm internal diameter and a height of 750 mm. The active flotation zone, which was below the feed port and above the sparger, was 450 mm tall. The cleaning zone, which was above the feed port, was 210 mm tall. A commercial shear sparger with one air nozzle was installed at the bottom of the column. A coarse fraction (−10+30 mesh or −2.0+0.6 mm) containing 45.1% KCl, 53.9% NaCl and 1.0% water-insoluble minerals was prepared from a commercial sylvinite ore A by screening and was floated in this apparatus as a function of the flowrate of brine pumped through the shear sparger. Before feeding, 1000 g of the sample was deslimed by tumbling and decantation and was conditioned in 1000 ml of saturated brine with 10 g/t carboxymethylcellulose, 200 g/t ARMEEN HTD hydrogenated tallow amine, 1346 g/t of emulsified ESSO 2600 oil containing 1% w/v ARMEEN HTD amine, and 420 g/t methyl-iso-butylcarbinol (MIBC) frother for four minutes. The conditioned potash particles were separated from the brine with the latter being mixed with fresh brine and were circulated in the device through the shear sparger at various flow rates ranging from 1.0 to 2.0 liter/minute while the air flowrate was kept at 1.0 or 2.0 liter/minute. In this series of tests, no brine was withdrawn from port 9 of the column.

Figure 2:
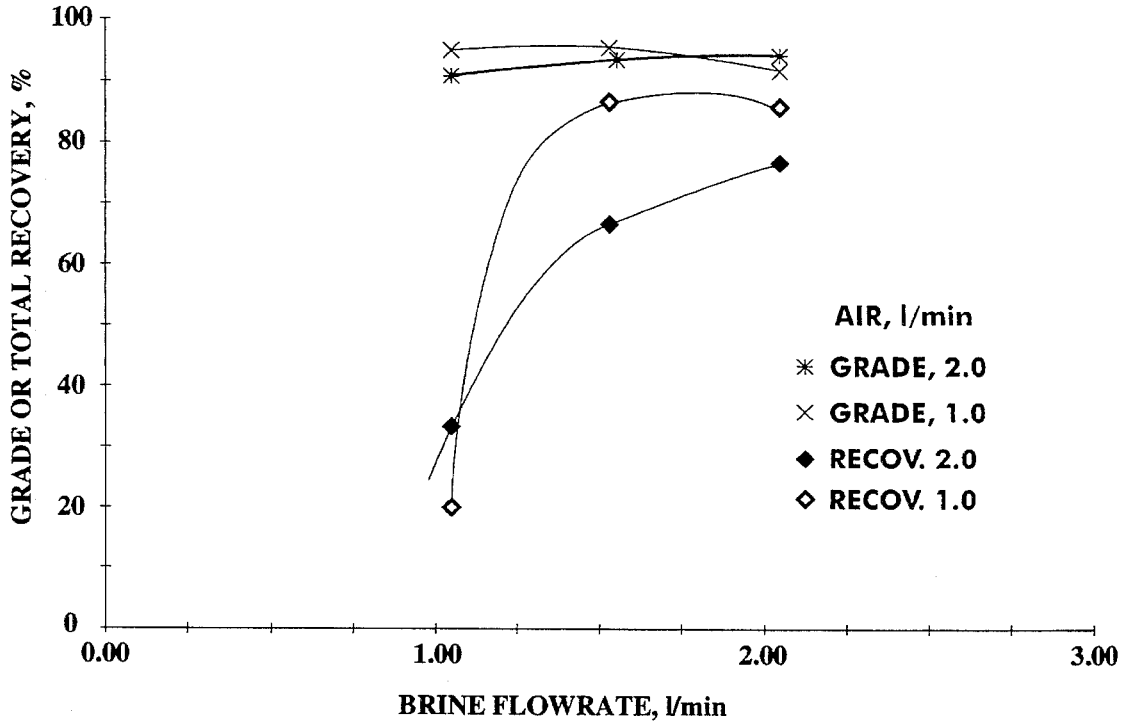
FIG. 2 shows the effect of flow rate of brine injected into the column through a "shear" sparger on recovery of coarse potash particles.

As shown in FIG. 2 and Table I, high grade potash concentrates were obtained following this method. The flotation recovery increased with increase of the flowrate of brine passing through the shear sparger. This shows that a high flowrate of the brine passing through the shear sparger is needed for good flotation. A high brine flowrate affected the grade of concentrates due to a higher upward brine velocity. Optimum flotation (flotation recovery of 87.5% and concentrate grade of 96.1%) was obtained with an air flowrate of 1.0 liter/minute and a flowrate of brine passing through the shear sparger of 1.5 liters/minute.

TABLE I

| Air Flowrate (l/min) | Brine Flowrate* (l/min) | Concentrate Grade (% KCl) | Flotation Recovery (%) |
|---|---|---|---|
| 1.0 | 1.0 | 95.4 | 18.8 |
| 1.0 | 1.5 | 96.1 | 87.5 |
| 1.0 | 2.0 | 91.6 | 87.0 |
| 2.0 | 1.0 | 90.7 | 33.7 |
| 2.0 | 1.5 | 95.5 | 66.3 |
| 2.0 | 2.0 | 92.5 | 78.9 |

*Flowrate of brine passing through the shear sparger.

EXAMPLE 2

Figure 3:
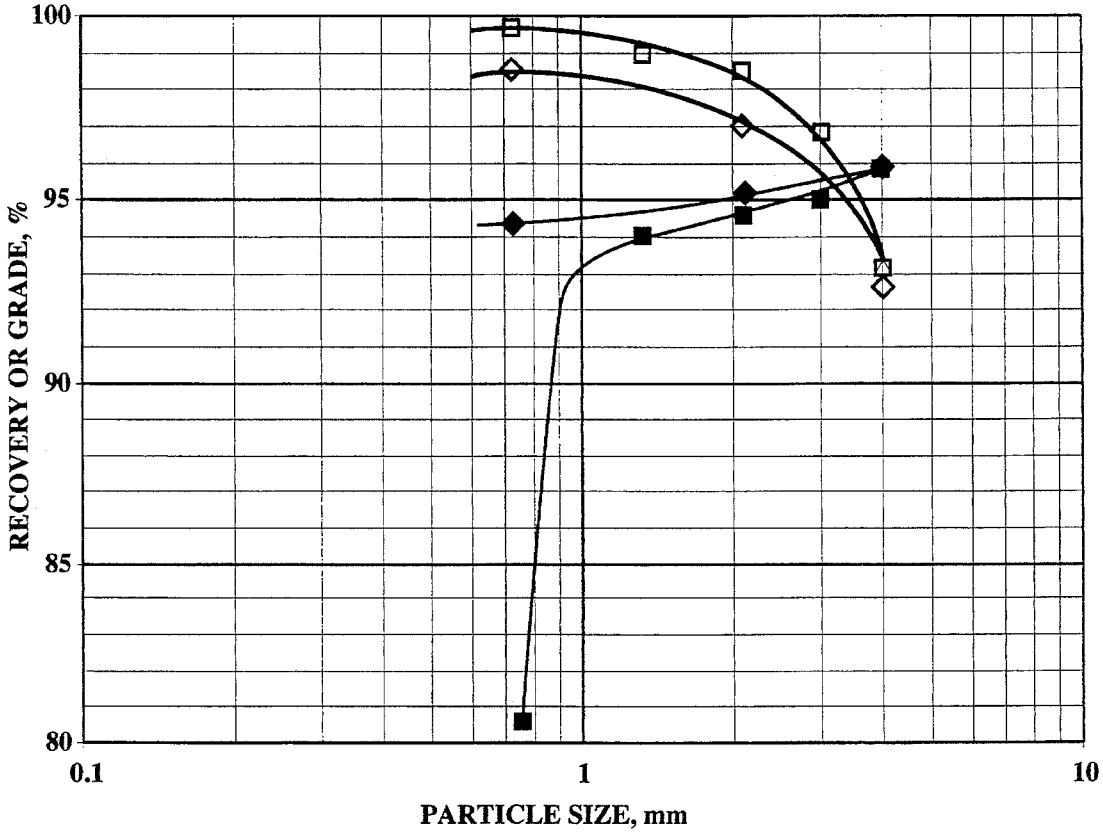
FIG. 3 shows the effect of net upward pulp velocity on the flotation recovery and concentrate grade of coarse potash particles at a constant flow rate of brine injected through the sparger.

Several coarse fractions with different size ranges were prepared from sylvinite ore A. Flotation tests were conducted with the same prototype column and the same conditioning procedure as described above in Example 1. The effect of the net upward brine velocity on the flotation of potash particles of different sizes was examined. The results are shown in FIG. 3 and Table II. High recoveries were obtained from the flotation of coarse potash particles with sizes up to 5 mm. As can be seen, the upward brine velocity had only marginal effect on the concentrate grade of very coarse potash particles, but it affected the concentrate grade when finer fractions were floated. This problem was corrected by reducing the upward brine velocity (by withdrawing brine from port 9) while keeping constant the flowrate of brine passing through the shear sparger. At lower upward brine velocity, the concentrate grade of the −18+ mesh fraction was increased from 80.6% to 94.4% KCl. Reduction of the net upward brine velocity was more important when a coarse fraction containing a large amount of fine particles was treated:

TABLE II

| Particles Size Mesh | Brine Flowrate I*, l/min | Brine Flowrate II**, l/min | Upward Velocity cm/sec | Concentrate Grade % KCl | Flotation Recovery % |
|---|---|---|---|---|---|
| −4+6 | 1.5 | 0 | 0.83 | 95.8 | 93.3 |
| −4+6 | 1.5 | −1.2 | 0.17 | 95.9 | 92.9 |
| −4+6 | 1.5 | +1.5 | 1.66 | 93.4 | 93.4 |
| −6+8 | 1.5 | 0 | 0.83 | 94.9 | 96.6 |
| −8+10 | 1.5 | 0 | 0.83 | 94.5 | 98.5 |
| −8+10 | 1.5 | −1.2 | 0.17 | 95.1 | 97.1 |
| −10+18 | 1.5 | 0 | 0.83 | 94.0 | 99.1 |
| −18+30 | 1.5 | 0 | 0.83 | 80.6 | 99.8 |
| −18+30 | 1.5 | −1.2 | 0.17 | 94.4 | 97.6 |

Air flowrate 1.0 l/min.
*brine supplied through the shear sparger.
**brine supplied through the second outlet port (− when flowing out, + when flowing in).

EXAMPLE 3

Flotation of coarse fractions of four sylvinite ores was tested with the prototype column. Some of the results are listed in Table III. An aqueous solution of ARMEEN TD tallow amine or an emulsion of ESSO 2600 brand oil containing ARMEEN HTD amine was used as the collector. The rest of the conditioning procedure was the same as described in Example 1. By using the method of the present invention, both high recovery and a high concentrate grade were obtained:

TABLE III

| Sample | | | | Concentrate | |
|---|---|---|---|---|---|
| Sample (Size range) | KCl, % | Water-insoluble minerals, % | Collector Used | Grade, % KCl | Flotation Recovery, % |
| A (−3½+18 mesh) | 35.9 | 1.5 | 100 g/t ARMEEN $TD_{(aq)}$ | 96.9 | 94.5 |
| A (−3½+18 mesh) | 35.9 | 1.5 | 225 g/t ESSO 2600 oil (10% ARMEEN HTD) | 96.5 | 96.5 |
| B (−6+18 mesh) | 33.4 | 6.8 | 900 g/t ESSO 2600 oil (4% ARMEEN HTD) | 92.7 | 88.7 |
| C (−6+18 mesh) | 24.5 | 3.9 | 900 g/t ESSO 2600 oil (10% ARMEEN HTD) | 85.6 | 88.6 |
| D (−6+18 mesh) | 38.6 | 2.3 | 900 g/t ESSO 2600 oil (4% ARMEEN HTD) | 70.5 | 96.6 |
| D (−10+18 mesh) | 40.1 | 2.0 | 900 g/t ESSO 2600 oil (4% ARMEEN HTD) + 6 g/t ARMEEN $HTD_{(aq)}$ | 78.6 | 93.2 |

Air flowrate 1.0 l/min.
Brine flowrate 1.5 l/min.
CCM 10 g/t, MIBC 167 g/t.

The foregoing Examples, since they represent only certain embodiments of the present invention, should not be used to restrict the scope of protection to be accorded to that invention. The scope of protection sought is set forth in the claims which follow.

I claim:

1. A flotation process for the beneficiation of a coarse potash ore fraction in saturated brine containing frother which comprises:

(a) providing a column-type flotation device and generating fine air bubbles in a lower portion of said column-type flotation device by a shear sparger in which high intensity shearing is employed to mix and disperse air into a brine flow containing the frother as said mixture of air and brine flow are fed into the column-type flotation device, feeding a coarse conditioned potash ore brine suspension into the top portion of the column-type flotation device, said coarse potash ore brine suspension being conditioned with a frother and at least one reagent selected from the group consisting of hydrocarbon extender oil and a long chain primary amine;

(b) removing a portion of the brine suspension from said column-type flotation device at a point above said shear sparger and below the location of the feeding of the potash ore brine suspension to reduce the upward flowrate of the brine suspension past the point where the air is dispersed into the brine suspension and to thereby reduce fine particle entrainment in a floated flotation product; and (c) collecting a beneficiated coarse potash fraction at the top of the column-type flotation device as said floated flotation product and removing a non-float tailing at the bottom of the column-type flotation device.

2. A process as claimed in claim 1 wherein the conditioned coarse potash ore brine suspension is conditioned with a frother and a hydrocarbon extender oil containing a dissolved saturated long chain primary amine.

3. A process as claimed in claim 1 wherein the conditioned coarse potash ore brine suspension is conditioned a frother and an aqueous composition comprising an unsaturated long chain primary amine having an iodine value of from about 20 to about 70 cg/g.

4. A process as claimed in claim 2 wherein the amine is emulsified in the presence of an acid.

5. A process as claimed in claim 4 wherein the acid is a mineral acid.

6. A process as claimed in claim 4 wherein the acid is a carboxylic acid.

7. A process as claimed in claim 2 wherein the amine has an iodine number of less than 20 cg/g.

8. A process as claimed in claim 2 wherein the amine has a chain length of from about eight to about twenty-two carbon atoms.

9. A process as claimed in claim 2 wherein the amine is a hydrogenated tallow amine.

10. A process as claimed in claim 2 wherein the hydrocarbon extender oil containing the amine is used with an aqueous composition of a long chain primary amine.

11. A process as claimed in claim 3 wherein the unsaturated primary amine is a tallow amine with an iodine number of from about 45 to about 60 cg/g.

* * * * *

UNITED STATES PATENT AND TRADEMARK OFFICE

CERTIFICATE OF CORRECTION

PATENT NO. : 5,456,362

DATED : October 10, 1995

INVENTOR(S) : J.S. Laskowski; Qun Wang

It is certified that error appears in the above—identified patent and that said Letters Patent is hereby corrected as shown below:

On the Title page, item [54];
In the Title and at the top of Col. 1, the words "FLUTATION" (both occurrences) should read -- FLOTATION --;

Col. 5, line 27, the words "I claim" should read -- We claim --; and

Col. 6, line 28, the word "conditioned" in line 2 of Claim 3 should be amended to read -- conditioned in the presence of --.

Signed and Sealed this

Eleventh Day of June, 1996

*Attest:*

Bruce Lehman

BRUCE LEHMAN

*Attesting Officer*

*Commissioner of Patents and Trademarks*